US008669932B2

(12) United States Patent
Kim

(10) Patent No.: US 8,669,932 B2
(45) Date of Patent: Mar. 11, 2014

(54) LIQUID CRYSTAL DISPLAY CAPABLE OF ADJUSTING BRIGHTNESS LEVEL IN EACH OF PLURAL DIVISION AREAS AND METHOD OF DRIVING THE SAME

(75) Inventor: Hong Chul Kim, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 1230 days.

(21) Appl. No.: 11/474,554

(22) Filed: Jun. 26, 2006

(65) Prior Publication Data

US 2007/0002003 A1 Jan. 4, 2007

(30) Foreign Application Priority Data

Jun. 29, 2005 (KR) ..... 10-2005-0057108

(51) Int. Cl.
*G09G 3/36* (2006.01)

(52) U.S. Cl.
USPC ..... 345/102; 345/87; 345/89

(58) Field of Classification Search
USPC ..... 345/87, 89, 102
See application file for complete search history.

(56) References Cited

U.S. PATENT DOCUMENTS

| | | | | |
|---|---|---|---|---|
| 2004/0008177 | A1* | 1/2004 | Ahn | 345/102 |
| 2005/0057486 | A1* | 3/2005 | Aoki et al. | 345/102 |
| 2006/0279522 | A1 | 12/2006 | Kurihara | |

FOREIGN PATENT DOCUMENTS

| | | |
|---|---|---|
| CN | 1619630 A | 5/2005 |
| JP | 2004-191490 | 7/2004 |
| KR | 10-2004-0005521 | 1/2004 |

OTHER PUBLICATIONS

Kurihara, Hiroshi. "LCD Device (Dec. 9, 2002)." JP 2002-356890 (as translated and referenced via U.S. Patent No. 7,113,164 B1).*
Office Action issued in corresponding Chinese Patent Application No. 2006100837651; issued Apr. 4, 2008.
Office Action issued in corresponding Korean Patent Application No. 10-2005-0057108, mailed Jul. 26, 2011.

* cited by examiner

*Primary Examiner* — Jonathan Horner
(74) *Attorney, Agent, or Firm* — Brinks, Gilson & Lione

(57) ABSTRACT

A liquid crystal display and a driving method thereof are provided. The liquid crystal display comprises a liquid crystal panel; a gate driver; a data driver; a timing controller supplying a control signal of the gate driver and a control signal of the data driver and supplying a brightness variable signal depending on an average of gray levels of image data; and a backlight unit adjusting a brightness level of the lamp in response to a plurality of brightness variable signals, wherein the timing controller divides the liquid crystal panel into a first division area, which displays image data, equal to or smaller than an average of reference gray levels and dispersion of reference gray levels and a second division area comprising areas other than the first division area by calculating an average and dispersion of gray levels of the image data with a line unit, and supplies a first brightness variable signal adjusting a brightness level of the first division area and a second brightness variable signal adjusting a brightness level of the second division area.

6 Claims, 3 Drawing Sheets

LIQUID CRYSTAL DISPLAY CAPABLE OF ADJUSTING BRIGHTNESS LEVEL IN EACH OF PLURAL DIVISION AREAS AND METHOD OF DRIVING THE SAME

This application claims priority under 35 U.S.C. §119(a) on Patent Application No. 10-2005-0057108 filed in Korea on Jun. 29, 2005, the entire contents of which are hereby incorporated by reference.

BACKGROUND

1. Technical Field

The technical field relates to a liquid crystal display that can adjust a brightness level in each of a plurality of division areas and a driving method thereof. More particularly, the technical field relates to a liquid crystal display which can differently adjust a brightness level of an image area displayed with an image and a brightness level of a blank area displayed with a black color when the displayed image and displayed blank area exist in one screen and a driving method thereof.

2. Description of the Background Art

In today's information-oriented society, electronic display devices play a very important role and various electronic display devices are extensively used in various industry fields. As a result, an electronic display device field has been developed and electronic display devices that meet the demands of this information-oriented society have been developed. In general, an electronic display device is an apparatus for transmitting a variety of information to a human being through the sense of sight. That is, an electronic display device is an electronic apparatus for converting electronic information signals input from various electronic apparatuses into light information signals, which are perceivable by sight and transmits visual information.

In these electronic display devices, an apparatus that displays a light information signal by emitting light is known as a light-emitting display device. Conversely an apparatus that displays a light information signal with light modulation by reflection, scattering, or interference is known as a light-receiving display device. A light-emitting display device can also be known as an active display device. Examples of active display devices include a cathode ray tube (CRT), a plasma display panel (PDP), an organic electroluminescent display (OELD), and a light-emitting diode (LED). A light-receiving display device can also be known as a passive display device. Examples of passive display devices include a liquid crystal display (LCD) and an electrophoretic image display (EPID).

The CRT, which is often found in a television or a computer monitor and has been used for the longest time, has the largest market share in terms of economical efficiency. However, the CRT has negative characteristics such as heavy weight, large bulk, and high power consumption.

Recently, because of lowered voltage requirements and reduced power requirements of various electronic devices and decreases in size, thickness, and weight of electronic apparatuses due to rapid progress of semiconductor technology, demand for flat panel-type display devices has rapidly increased. Accordingly, a flat panel-type display device such as a liquid crystal display (LCD), a plasma display (PDP), and an organic electroluminescent display (OELD) have been developed. Among these flat panel-type display devices, a liquid crystal display that has a decreased size, thickness, and weight in addition to a lower driving voltage and lower power consumption has been particularly sought after.

As described above, because a liquid crystal display is not a light emitting display, it requires a light source such as a backlight. In general, there are two types of backlights for a liquid crystal display: a direct type and a light guide plate type. The direct type backlight has several lamps disposed in a flat surface and constantly sustains a gap between a lamp and a liquid crystal panel by providing a diffusion plate between the lamp and the liquid crystal panel. The light guide plate-type backlight has a lamp located at the outside of a flat surface, such that light is applied to an entire surface of the liquid crystal panel from the lamp by using a transparent light guide plate.

To more effectively display moving images or movie images in a conventional liquid crystal display, a brightness level of the lamp of the backlight is adjusted depending on an average of gray levels of the input image data. That is, a brightness level of the lamp of the backlight is greatly adjusted when a bright image is input, compared with when a dark image is input.

However, in the conventional liquid crystal display, when an image area displayed with an image and a blank area displayed with a black color both exist in one screen, the brightness level of the image area and that of a blank area are simultaneously adjusted. Therefore, when a bright image is displayed in the image area, brightness levels of both of the blank area and the image area are highly adjusted. Thus, due to the increase of the brightness level of the black color of the blank area, there is a problem that the concentration and contrast ratio for the image area are deteriorated.

SUMMARY

Described herein is a liquid crystal display that can adjust a brightness level in each of a plurality of division areas by differently adjusting a brightness level of an image area in which an image is displayed and that of a blank area in which a black color is displayed. Also described herein is a driving method that displays both an image area, in which an image is displayed, and a blank area, in which a black color is displayed, on one screen.

Further described herein is a liquid crystal display that can adjust a brightness level in each of a plurality of division areas. The liquid crystal display comprises a liquid crystal panel in which pixels are formed at intersections of a plurality of gate lines and a plurality of data lines and a gate driver supplying a scan signal to the plurality of gate lines. The liquid crystal display also includes a data driver that converts input image data into analog pixel signals and that supplies the analog pixel signals to the plurality of data lines. The liquid crystal display panel further includes a timing controller that supplies a control signal to the gate driver and a control signal to the data driver, and that supplies a brightness variable signal depending on an average of gray levels of the image data. The liquid crystal display panel additionally includes a backlight unit that adjusts a brightness level of a plurality of lamps in response to the brightness variable signal, such that the timing controller divides the liquid crystal panel into a first division area and a second division area. The first division area is equal to or less than an average of reference gray levels and dispersion of reference gray levels, and the second division area comprises areas other than the first division area by calculating an average and dispersion of gray levels of the image data with a line unit. The timing controller also supplies a first brightness variable signal that adjusts a brightness level of the first division area and a second brightness variable signal that adjusts a brightness level of the second division area.

Further described herein is a method of driving a liquid crystal display that adjusts a brightness level in each of a plurality of division areas. The method comprises calculating an average and dispersion of gray levels of input image data with a line unit and dividing a liquid crystal panel into a first division area and a second division area. The first division area is equal to or less than an average of reference gray levels and dispersion of reference gray levels, and the second division area comprises areas other than the first division area based on an average and dispersion of gray levels of the image data with a line unit. The method further comprises adjusting a brightness level of the first division area dependent on an average of grade levels of the first division area and adjusting a brightness level of the second division area dependent on an average of grade levels of the second division area.

BRIEF DESCRIPTION OF THE DRAWINGS

These and other aspects of the disclosure will be apparent from the following detailed description of the examples shown in the accompanying drawings, in which.

DETAILED DESCRIPTION

Reference will now be made in detail to the examples, which are illustrated in the accompanying drawings. Wherever possible, the same reference numbers will be used throughout the drawings to refer to the same or like parts.

Figure 1:
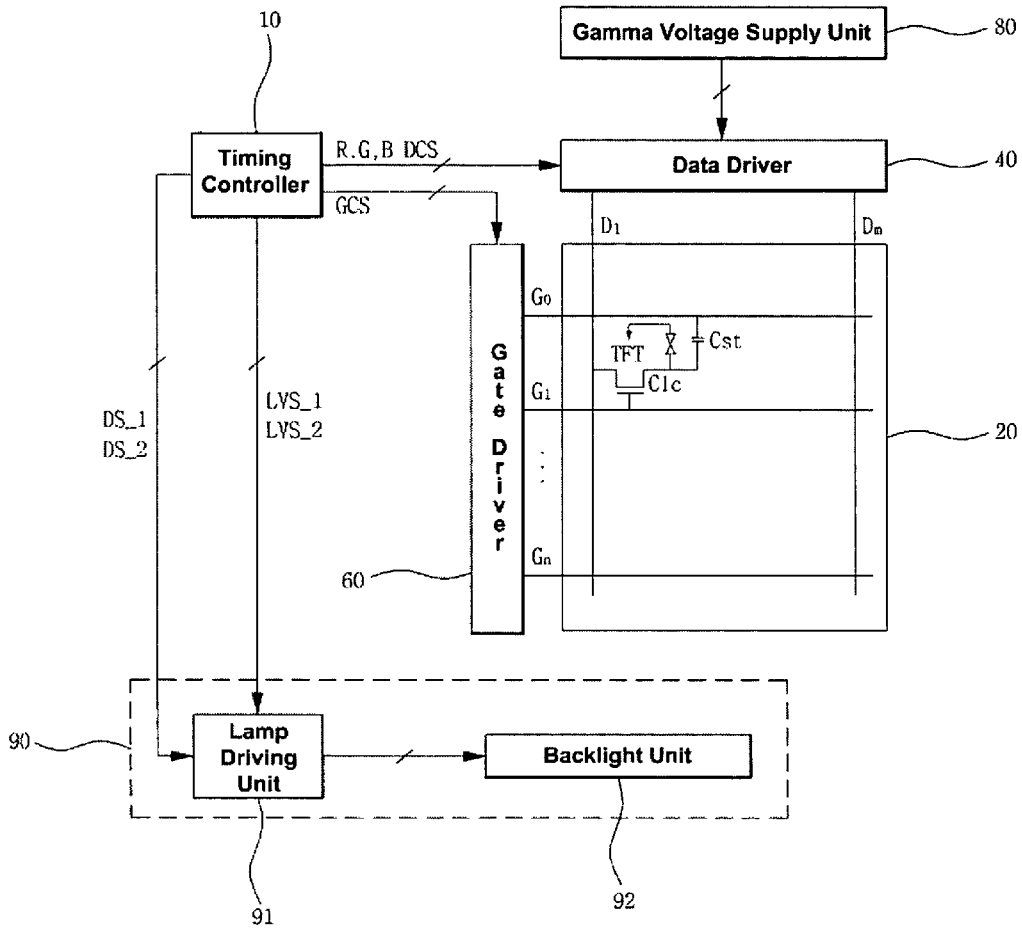
FIG. 1 is a diagram illustrating one configuration of a liquid crystal display.

As shown in FIG. 1, the liquid crystal display has an m×n number of liquid crystal cells, where m and n are both natural numbers. The m×n number of liquid crystal cells (Clc) are arranged in a matrix shape such that pixels are formed at intersections of the m number of data lines (D1 to Dm) and the n number of gate lines (G1 to Gn), and thin film transistors (TFT) are formed in the pixels. The liquid crystal display comprises a liquid crystal panel 20 for displaying pixel data, a data driver 40 for supplying pixel signals to data lines (D1 to Dm) of the liquid crystal panel 20, a gate driver 60 for supplying scan signals to gate lines (G1 to Gn), and a gamma voltage supply unit 80 for supplying a gamma voltage to the data driver 40. The liquid crystal display also comprises a timing controller 10 for controlling the gate driver 60 and the data driver 40 and for supplying brightness variable signals (LVS_1 and LVS_2) depending on an average of gray levels of image data (R, G, and B). The liquid crystal display further has a backlight unit 90 for adjusting a brightness level of a lamp in response to the brightness variable signals (LVS_1 and LVS_2).

The liquid crystal panel 20 has a plurality of liquid crystal cells (Clc) arranged in a matrix shape at the intersections of the data lines (D1 to Dm) and the gate lines (G1 to Gn). Thin film transistors (TFT) formed in each of liquid crystal cells (Clc) respond to scan signals applied to the gate lines (G1 to Gn) and supplies pixel signals supplied from the data lines (D1 to Dm) to the liquid crystal cells (Clc). Further, storage capacitors (Cst) are formed in each of liquid crystal cells (Clc). The storage capacitor (Cst) is formed between a pixel electrode of the liquid crystal cells (Clc) and a front end gate line or between the pixel electrode of the liquid crystal cell (Clc) and a common electrode line to constantly sustain a voltage of the liquid crystal cell (Clc).

The gamma voltage supply unit 80 supplies a plurality of gamma voltages to the data driver 40 so as to generate an analog pixel signal.

The timing controller 10 generates a gate control signal (GCS) and a data control signal (DCS) by using input synchronous signals. The timing controller 10 supplies the gate control signal (GCS) to the gate driver 60, and supplies the data control signal (DCS) to the data driver 40. The timing controller 10 rearranges the input image data, and supplies the rearranged input image data (R, G, and B) to the data driver 40. Furthermore, the timing controller 10 supplies on and off signals (DS_1 and DS_2) for driving the lamp driving unit 91 and brightness variable signals (LVS_1 and LVS_2) for adjusting a brightness level of a lamp of the backlight unit 92 depending on an average of gray levels of the image data (R, G, and B) supplied to the lamp driving unit 91.

The data driver 40 supplies one line amount of image data (R, G, and B) to the data lines (D1 to Dm) in response to the data control signal (DCS) supplied by the timing controller 10. Specifically, the data driver 40 converts the image data (R, G, and B) input from the timing controller 10 into analog pixel signals by using gamma voltage from the gamma voltage supply unit 80 and supplies the converted analog pixel signals to the data lines (D1 to Dm).

The gate driver 60 receives the gate control signal (GCS) from the timing controller 10, generates a scan signal, and sequentially supplies the generated scan signal to the gate lines (G1 to Gn). Accordingly, the thin film transistors (TFT) connected to the gate lines (G1 to Gn) are sequentially driven.

Figure 2:
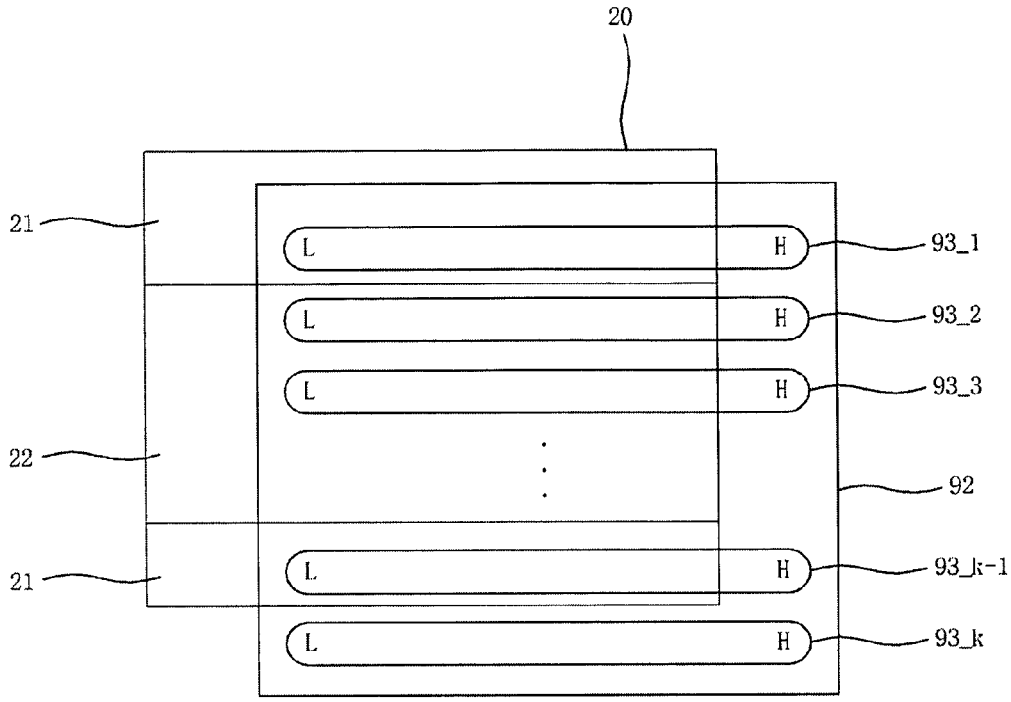
FIG. 2 is a diagram illustrating lamps of a backlight unit disposed in a low part of a liquid crystal panel shown in FIG. 1.

The backlight unit 90 comprises a lamp driving unit 91 and a backlight unit 92. As shown in FIG. 2, the backlight unit 92 is disposed in a lower part of the liquid crystal panel 20 to irradiate light to the liquid crystal panel 20, thereby displaying a desired image. Such a backlight unit 92 comprises a plurality of lamps (93_1 to 93_*k*). The plurality of lamps (93_1 to 93_*k*) are arranged in parallel. When an AC waveform is applied to a high voltage electrode (H) and a low pressure electrode (L), electrons emitted from the low pressure electrode (L) collide with inactive gases within a glass tube, so that electrons exponentially increase. A current flows into the glass tube due to the increased electrons, whereby ultraviolet rays are emitted while inactive gases are excited. These ultraviolet rays collide with a luminescent phosphor coated on an inside wall of the glass tube, whereby visible rays are emitted.

Figure 3:
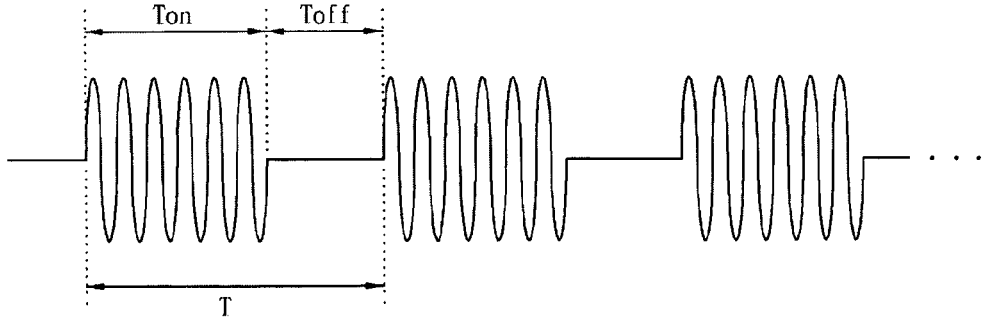
FIG. 3 is a waveform diagram illustrating a burst mode type of AC waveform supplied to each lamp of the backlight unit shown in FIG. 2.
Figure 4:
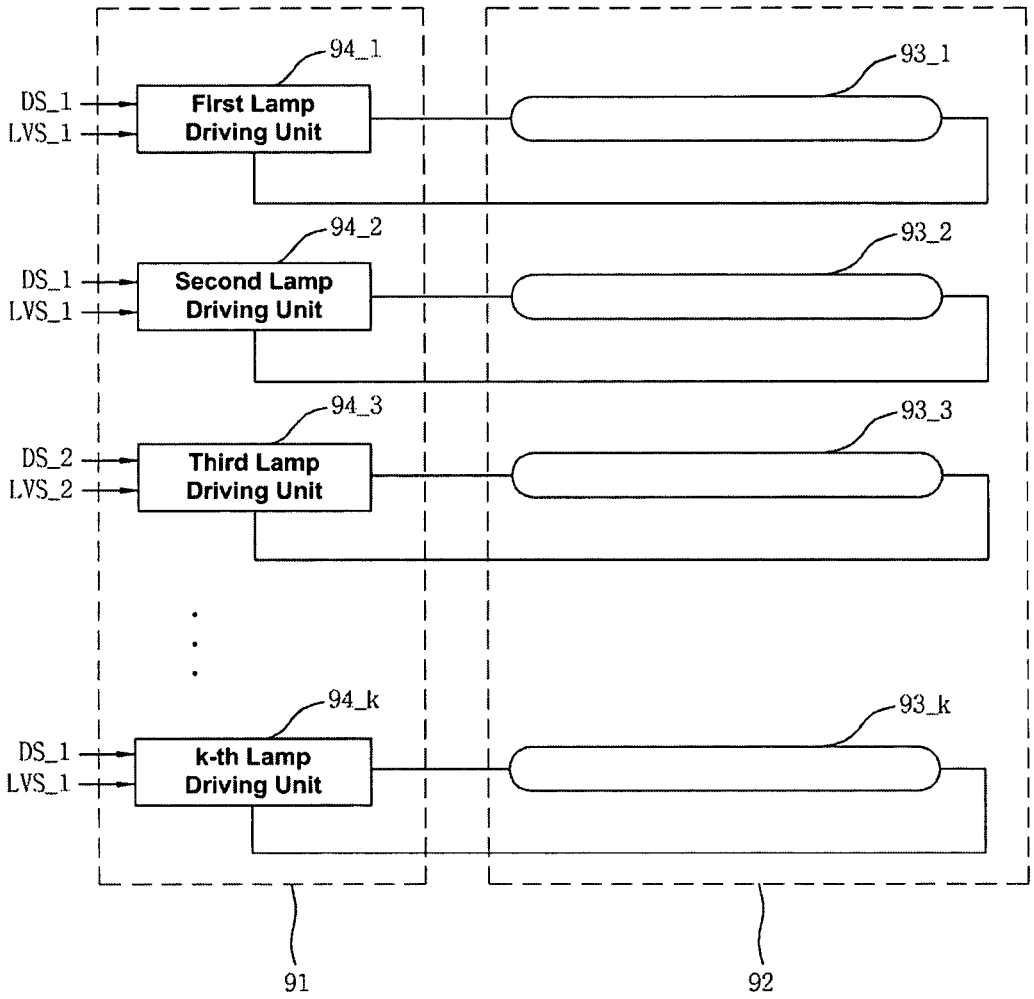
FIG. 4 is a diagram illustrating a detailed configuration of a lamp driving unit and the backlight unit shown in FIG. 1.

As shown in FIG. 4, the lamp driving unit 91 is driven by on and off signals (DS_1 and DS_2) from the timing controller 10, converts a DC voltage supplied from the outside into a burst mode type of AC waveform in response to brightness variable signals (LVS_1 and LVS_2), and supplies the converted AC waveform to each of the plurality of lamps (93_1 to 93_*k*). The burst mode type of AC waveform is shown in FIG. 3.

The timing controller 10 calculates an average and dispersion of gray levels of the image data (R, G, and B) with a line unit (not shown). The liquid crystal panel 20 is divided into a first division area 21 which displays image data (R, G, and B) equal to or less than an average of reference gray levels and dispersion of the reference gray levels and a second division area 22 comprising areas other than the first division area 21, based on an average and dispersion of gray levels of the image data (R, G, and B). The timing controller 10 supplies the first brightness variable signal (LVS_1), which adjusts a brightness level of the first division area 21, and the second brightness variable signal (LVS_2), which adjusts a brightness level of the second division area 22.

For example, if an average of the reference gray levels is set to 20 gray levels and dispersion of the reference gray levels is set to 10 gray levels when a gray level is an 8-bit signal, an area which displays the image data (R, G, and B) equal to or smaller than an average of the reference gray levels and dispersion of the reference gray levels among the liquid crystal panel 20 becomes the first division area 21, and the first division area 21 is classified as a blank area displayed with a black color. The second division area 22 that comprises areas other than the first division area 21 then becomes an image area in which an image is displayed. In this example, an average of the reference gray levels and dispersion of the reference gray levels may be variously set depending on resolution of the displayed image or the size of the blank area displayed with a black color.

In one example of the liquid crystal display, an average and dispersion of gray levels of the image data are calculated with a line unit. By dividing the liquid crystal panel 20 into a blank area 21 displayed with a black color and an image area 22 displayed with an image, the image area that displays an image having a low brightness level and a blank area displayed with a black color can be effectively divided and the blank area can be effectively displayed with various kinds of images or various sizes of images.

The timing controller 10 also supplies the first brightness variable signal (LVS_1), which adjusts a brightness level of the first division area 21 and the second brightness variable signal (LVS_2), which adjusts a brightness level of the second division area 22. The first brightness variable signal (LVS_1) is supplied to a lamp driving unit 91 for adjusting a brightness level of lamps (for example, 93_1, 93_2, 93_*k*−1, and 93_*k*) of a backlight unit 92 disposed in a lower part of the first division area 21 to irradiate light to the first division area 21, and the second brightness variable signal (LVS_2) is supplied to the lamp driving unit 91 for adjusting a brightness level of lamps (for example, 93_3 to 93_*k*−2) of the backlight unit 92 disposed in a lower part of the second division area 22 to irradiate light to the second division area 22.

As shown in FIG. 3, the lamp driving unit 91 converts a DC voltage supplied from the outside into a burst mode type of AC waveform in response to the first brightness variable signal (LVS_1) supplied from the timing controller 10 and supplies the converted AC waveform to the lamps (for example, 93_1, 93_2, 93_*k*−1, and 93_*k*) of the backlight unit 92 disposed in a lower part of the first division area 21 to irradiate light to the first division area 21.

The first brightness variable signal (LVS_1) adjusts the on-time (Ton) of the burst mode type of AC waveform depending on the average of gray levels of the first division area 21. That is, where the first brightness variable signal (LVS_1) has a high average of gray levels, the first division area 21 is adjusted to have an on-time (Ton) longer than a brightness variable signal having a low average of gray levels of the first division area 21. Accordingly, a brightness level of the first division area 21 can be adaptively adjusted depending on an average of gray levels of the first division area 21. Here, the on-time (Ton) of a burst mode type of AC waveform can be extended to a frame cycle time (T). During the on-time (Ton) of a burst mode type of AC waveform, the lamps (for example, 93_1, 93_2, 93_*k*−1, and 93_*k*) of the backlight unit 92, which are disposed in a lower part of the first division area 21 to irradiate light to the first division area 21, are turned on and during the off-time (Toff) of a burst mode type of AC waveform, the lamps (for example, 93_1, 93_2, 93_*k*−1, and 93_*k*) of the backlight unit 92 are turned off.

Furthermore, as shown in FIG. 3, the lamp driving unit 91 converts a DC voltage supplied from the outside into a burst mode type of AC waveform in response to the second brightness variable signal (LVS_2) supplied from the timing controller 10 and supplies the converted AC waveform to the lamps (for example, 93_3 to 93_*k*−2) of the backlight unit 92 disposed in a lower part of the second division area 22 to irradiate light to the second division area 22.

The second brightness variable signal (LVS_2) adjusts an on-time (Ton) of a burst mode type of AC waveform depending on an average of gray levels of the second division area 22. That is, where the second brightness variable signal (LVS_2) has a high average of gray levels of the second division area 22, the second division area 22 is adjusted to have an on-time (Ton) longer than a brightness variable signal having a low average of gray levels of the second division area 22. Accordingly, a brightness level of the second division area 22 can be adaptively adjusted depending on the average of gray levels of the second division area 22. Here, the on-time (Ton) of a burst mode type of AC waveform can be extended to a frame cycle time (T). During the on-time (Ton) of a burst mode type of AC waveform, the lamps (for example, 93_3 to 93_*k*−2) of the backlight unit 92, which are disposed in a lower part of the second division area 22 to irradiate light to the second division area 22, are turned on and during the off-time (Toff) of a burst mode type of AC waveform, the lamps (for example, 93_3 to 93_*k*−2) of the backlight unit 92 are turned off.

In the liquid crystal display, as brightness levels of the image area 22 and the blank area 21 displayed are differently adjusted, brightness levels of the image area 22 are adaptively adjusted depending on an average of brightness levels of the image area 22, and brightness levels of the blank area 21 are adaptively adjusted depending on an average of brightness levels of the blank area 21. Thus, the increase in the brightness level of the black color of the blank area 21 is efficiently suppressed, so that concentration to the image area 22 and a contrast ratio of an image are effectively increased.

Here, because the second division area 22 is used as the image area 22 in which an image is displayed and the first division area 21 is used as the blank area 21 displayed with a black color, the timing controller 10 can adjust a brightness level of the second division area 22 to be higher than that of the first division area 21.

As shown in FIG. 4, the lamp driving unit 91 comprises a plurality of lamp driving units (94_1 to 94_*k*) and the backlight unit 92 comprises a plurality of lamps (93_1 to 93_*k*), and the plurality of lamp driving units (94_1 to 94_*k*) supplies a burst mode type of AC waveform shown in FIG. 3 to the plurality of lamps (93_1 to 93_*k*), respectively.

When the lamps of the backlight unit 92 disposed in a lower part of the first division area 21 to irradiate light to the first division area 21 are a first lamp (93_1), a second lamp (93_2), a (k−1)th lamp (93_*k*−1), and a k-th lamp (93_*k*), a first lamp driving unit (94_1), a second lamp driving unit (94_2), a (k−1)th lamp driving unit (94_*k*−1), and a k-th lamp driving unit (94_*k*) are driven by a first on-off signal (DS_1) from the timing controller 10 and the lamp driving units supply a burst mode type of AC waveform to lamps (93_1, 93_2, 93_*k*−1, and 93_*k*) of the backlight unit 92 for irradiating light to the first division area 21 in response to the first brightness variable signal (LVS_1). The first brightness variable signal (LVS_1) can adaptively adjust the brightness level of the first division area 21 depending on the average of brightness levels of the first division area 21 by adjusting the on-time (Ton) of a burst mode type of AC waveform depending on an average of gray levels of the first division area 21.

When the lamps of the backlight unit 92 disposed in a lower part of the second division area 22 are a third to (k−2)th lamps (93_3 to 93_*k*−2), a third to (k−2)th lamp driving units (94_3 to 94_*k*−2) are driven by a second on-off signal (DS_2) from the timing controller 10 and supply a burst mode type of AC waveform to the lamps (93_3 to 93_*k*−2) of the backlight unit 92 in response to the second brightness variable signal (LVS_2). The second brightness variable signal (LVS_2) can adaptively adjust the brightness level of the second division area 22 depending on the average of brightness levels of the second division area 22 by adjusting the on-time (Ton) of a burst mode type of AC waveform depending on an average of gray levels of the second division area 22.

As described above, in a liquid crystal display that adjusts a brightness level in each of a plurality of division areas and a driving method thereof, as a liquid crystal panel is divided into a blank area displayed with a black color and an image area in which an image is displayed by calculating an average and dispersion of gray levels of image data with a line unit, the image area which displays an image having a low brightness level and the blank area displayed with a black color can be effectively distinguished and the blank area can effectively display various kinds of images or various sizes of images.

In addition, as brightness levels of the image area and the blank area are differently adjusted, the brightness level of the image area is adaptively adjusted depending on the average of gray levels of the image area, and the brightness level of the blank area is adaptively adjusted depending on an average of gray levels of the blank area. Thus, the increase in a brightness level of the black color of the blank area can be effectively suppressed, so that concentration to the image area and a contrast ratio of an image can be effectively increased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display that can adjust a brightness level in each of a plurality of division areas, the liquid crystal display comprising:

a liquid crystal panel in which pixels are formed at intersections of a plurality of gate lines and a plurality of data lines, the liquid crystal panel being divided into a first division area and a second division area based on a comparison between image data and an average of reference gray levels and dispersion of the reference gray levels, the first division area being a blank area which displays black color having image data equal to or less than the average of the reference gray levels and dispersion of the reference gray level, the second division area being an area other than the first division area and that displays image data higher than the average of the reference gray levels and the dispersion of the reference gray level;

a gate driver that supplies a scan signal to the plurality of gate lines;

a data driver that converts an input image data into analog pixel signals and that supplies the converted pixel signals to the plurality of data lines;

a timing controller that supplies a first control signal to the gate driver, a second control signal to the data driver, and that supplies a first brightness variable signal to adjust a brightness level of the first division area and a second brightness variable signal to adjust a brightness level of the second division area; and a backlight unit that adjusts a brightness level of a first lamp irradiating a light to the first division area of the liquid crystal panel in response to the first brightness variable signal, and a brightness level of a second lamp irradiating a light to the second division area of the liquid crystal panel in response to the second brightness variable signal, wherein the timing controller generates the first brightness variable signal based on an average of brightness level of the first division area and the second brightness variable signal based on an average of brightness level of the second division area, the brightness levels of the first and second division areas are independently adjusted each other.

2. The liquid crystal display of claim 1, wherein the timing controller adjusts the brightness level of the second division area to be higher than the brightness level of the first division area.

3. The liquid crystal display of claim 1, wherein the backlight unit adjusts an on-time of the first lamp which irradiates light to the first division area in response to the first brightness variable signal and adjusts an on-time of a second lamp which irradiates light to the second division area in response to the second brightness variable signal.

4. A driving method of a liquid crystal display that can adjust a brightness level in each of a plurality of division areas, the method comprising:

calculating an average value and a dispersion value of gray levels of the input image data corresponding to each of data lines;

setting a reference of the average value and a reference of the dispersion value;

dividing a liquid crystal panel into a first division area and a second division area based on a comparison between the input image data and an average of reference gray levels and dispersion of the reference gray levels, wherein the first division area is a blank area which displays black color having image data equal to or less than the average of the reference gray levels and dispersion of the reference gray level, and the second division area is an area other than the first division area and that displays image data higher than the average of the reference gray levels and the dispersion of the reference gray level; and adjusting a brightness level of the first division area based on an average of brightness level of the first division area and adjusting a brightness level of the second division area based on an average of brightness level of the second division area.

5. The driving method of claim 4, wherein adjusting a brightness level comprises adjusting a brightness level of the second division area to be higher than that of the first division area.

6. The driving method of claim 4, wherein adjusting a brightness level comprises adjusting an on-time of a first lamp which irradiates light to the first division area in response to the first brightness variable signal and adjusting a second on-time of a lamp which irradiates light to the second division area in response to the second brightness variable signal.

* * * * *